US007080756B2

(12) United States Patent
Cunningham

(10) Patent No.: US 7,080,756 B2
(45) Date of Patent: Jul. 25, 2006

(54) BAG DISPENSING ASSEMBLY

(75) Inventor: Robert Cunningham, Smithtown, NY (US)

(73) Assignee: Uniflex, Inc., Hicksville, NY (US)

( * ) Notice: Subject to any disclaimer, the term of this patent is extended or adjusted under 35 U.S.C. 154(b) by 31 days.

(21) Appl. No.: 11/009,653

(22) Filed: Dec. 10, 2004

(65) Prior Publication Data

US 2006/0124657 A1 Jun. 15, 2006

(51) Int. Cl.
*B65H 3/58* (2006.01)
*B65H 1/00* (2006.01)
*B65D 1/34* (2006.01)
*B65D 6/04* (2006.01)

(52) U.S. Cl. ..... 221/26; 221/197; 206/554

(58) Field of Classification Search ..... 221/26, 221/27, 28, 197; 211/85.15, 12, 71; 248/95, 248/99, 100; 206/315.3, 554; 24/457, 458; 403/326, 329, 387, 388, 315, 316
See application file for complete search history.

(56) References Cited

U.S. PATENT DOCUMENTS 3,285,407 A * 11/1966 Abramson ..... 206/493
3,707,271 A * 12/1972 Sanchez et al. ..... 248/101
3,729,099 A * 4/1973 Kritske ..... 211/46
3,891,093 A * 6/1975 Petrie ..... 211/46
3,896,526 A * 7/1975 Joiner ..... 24/67.1
4,233,326 A * 11/1980 Sontag ..... 426/115
4,326,727 A * 4/1982 Rock ..... 280/851
4,537,330 A * 8/1985 Gelbard ..... 221/26
4,557,384 A * 12/1985 Membrino ..... 206/554
4,771,897 A * 9/1988 Ho ..... 211/85.9
5,011,356 A * 4/1991 Fernandez ..... 411/553
5,524,762 A * 6/1996 Shafran et al. ..... 206/554
5,695,065 A * 12/1997 Kennedy et al. ..... 206/554
D395,566 S * 6/1998 Helseth ..... D6/515
5,966,741 A * 10/1999 Klecina ..... 2/169
6,264,069 B1 * 7/2001 Hughes et al. ..... 222/129.1
6,389,723 B1 * 5/2002 Rink, Jr. ..... 40/642.02
6,526,626 B1 * 3/2003 LoTufo ..... 16/110.1
6,546,658 B1 * 4/2003 Pitcher et al. ..... 40/658
2002/0134702 A1 * 9/2002 DeSmedt et al. ..... 206/554
2003/0136703 A1 * 7/2003 Jones et al. ..... 206/554

* cited by examiner

*Primary Examiner*—Kathy Matecki
*Assistant Examiner*—Rakesh Kumar
(74) *Attorney, Agent, or Firm*—Carter, DeLuca, Farrell & Schmidt, LLP

(57) ABSTRACT

A bag dispensing assembly for holding a plurality of bags while having the ability to dispense a single bag. The bag dispensing assembly comprises a plurality of bags, a bag holding cartridge, a plurality of buttons and a bag dispenser. The bags contain holes which are positioned over raised portions of the bag holding cartridge. The buttons are used to secure the bags to the bag holding cartridge. The bag dispenser has slots to receive the bag holding cartridge, complete with the bags and buttons secured to it. A user may remove an individual bag from the bag dispensing assembly along a perforation line.

18 Claims, 7 Drawing Sheets

(flip horizontally)

BAG DISPENSING ASSEMBLY

BACKGROUND

The present disclosure relates to an assembly for dispensing bags and more particularly, the present disclosure relates to a plurality of bags secured to a bag holding cartridge with buttons, and a bag dispenser for receiving and maintaining the bag holding cartridge, the plurality of bags and buttons, and for allowing a user to remove one bag at a time from the assembly.

Employees at different types of locations, such as grocery stores, pharmacies, retail stores, etc., typically place merchandise that has been purchased into a bag before giving it to the customer. Therefore, such locations typically use many bags during the course of a day. Consequently, it is important to be able to store all of the bags while having the ability to easily select and use a single bag. An apparatus that can hold a plurality of bags and can dispense an individual bag would be desired at such locations.

SUMMARY

The present disclosure is directed to a bag dispensing assembly for holding a plurality of bags while having the ability to dispense a single bag. The bag dispensing assembly comprises a plurality of bags, a bag holding cartridge, a plurality of buttons and a bag dispenser.

The plurality of bags includes anywhere from a few bags to several hundred or even several thousand bags. Each bag has an open end and closed end, in addition to a front side and a back side. The material from one of the sides, preferably the back side, extends past the material from the other side. There is a perforation line on each bag, preferably located near where the shorter side of the bags ends (i.e., at the opening of the bag). A plurality of holes is disposed on the extended material of each bag. Preferably, there is one hole located near each edge of the bag and near the perforation line. This preferred alignment of holes facilitates the removal of the bag at its perforation line.

The bag holding cartridge includes a horizontal support member affixed to a vertical support member, and a plurality of raised portions. The vertical support member extends perpendicularly from the horizontal support member. The point of intersection between the two support members is preferably towards the back of the horizontal support member. The raised portions protrude outwardly (i.e., in the same direction as the front of the horizontal support member) from the vertical support member. The raised portions are for fitting into the holes of each of the bags. Therefore, the positioning of the raised portions are such that they line up with the holes of the bags when the bags are placed on the bag holding cartridge. Further, the circumference of the raised portions is smaller than the circumference of the holes of the bag. Preferably, both the holes and the raised portions are circular and the diameter of each raised portion is slightly smaller than the diameter of each hole. The length of the raised portions is at least as long as the thickness of the plurality of bags.

The bag holding cartridge also includes an opening extending through each raised portion and through the thickness of the vertical support member. The opening preferably has two circumferences separated by a lip, with the front (outward) facing circumference having a smaller circumference than the rear facing circumference.

Each button of the plurality of buttons comprises a proximal cap, an intermediate portion with two legs separated by a distance, and a distal portion comprising a detent on each leg. The proximal cap has a circumference that is larger than the circumference of each hole of the bags, for enabling the bags to be secured to the bag holding cartridge. The two legs are substantially parallel to one another and extend from the proximal cap in a cantilevered fashion. Consequently, the legs can deflect towards each other in response to an external force, thus shortening the distance between the legs and detents, where the distance between the detents is shortened at a greater rate. The outer circumference around both legs is smaller than the circumference of the proximal cap, and smaller than the circumference of the smaller opening of the bag holding cartridge. The outer circumference around the detents is larger than the circumference of the outer circumference of both legs, and smaller than the circumference of the smaller opening of the bag holding cartridge.

The various sizes of the button portions and the openings allow for insertion of each button into each opening of the bag holding cartridge. The buttons operate to secure the bags on the bag holding cartridge. This button-insertion process is discussed in further detail below. The combination of the plurality of bags, the bag holding assembly and the plurality of buttons is referred to as a bag carrying cartridge.

The bag dispenser is for receiving and maintaining the bag holding cartridge or the bag carrying cartridge. The bag dispenser includes a housing with a horizontal slot and a vertical slot disposed therein. Both slots run from a proximal portion of the housing towards a distal portion of the housing. The slots form an opening on the proximal portion, while the distal portion is preferably closed. The top of the housing is preferably closed, while the vertical slot extends through the bottom of the housing to create an opening. The horizontal slot is dimensioned and configured to receive the horizontal support member of the bag holding cartridge, and the vertical slot is dimensioned and configured to receive the vertical support member of the bag holding cartridge in addition to the plurality of bags disposed thereon. Further an indentation is disposed on the vertical slot to allow the buttons (that are inserted into the bag holding cartridge) to pass through. This orientation allows for the bag carrying cartridge to be inserted into the bag dispenser. The combination of the bag carrying cartridge and the bag dispenser comprise the bag dispensing assembly.

Preferably, a catch is disposed on a proximal portion of the vertical slot and/or the horizontal slot of the bag dispenser. The catch is for further maintaining the bag carrying cartridge in the bag dispenser even if the bag dispenser is tilted in a way that may normally cause the bag carrying cartridge to fall out of the bag dispenser.

It is envisioned that a magnet or other adhering material, such as Velcro™, tape, clips, etc., is disposed on the bag dispenser for securing the bag dispensing apparatus to a surface.

It is also envisioned that indicia is disposed on each bag and/or the bag dispenser for advertising purposes or for any other reasonable purpose.

In operation, with the bag carrying cartridge inserted into the bag dispenser, a user can remove a single bag from the bag dispensing assembly by grabbing a bag and pulling it away from the bag dispensing assembly. The bag will preferably tear along the perforation line and the user can then utilize the bag. The next bag is then ready to be removed and used. When all of the bags are removed (or even when some bags remain), the user can pull the bag holding cartridge out of the bag dispenser. The user can then insert a new bag carrying cartridge. The user can alternatively insert a plurality of bags to the bag holding cartridge that was removed and secure the bags thereto with the used buttons prior to re-insertion.

BRIEF DESCRIPTION OF THE DRAWINGS

Various embodiments of the subject assembly are described herein with reference to the drawings wherein.

DETAILED DESCRIPTION

Figure 1:
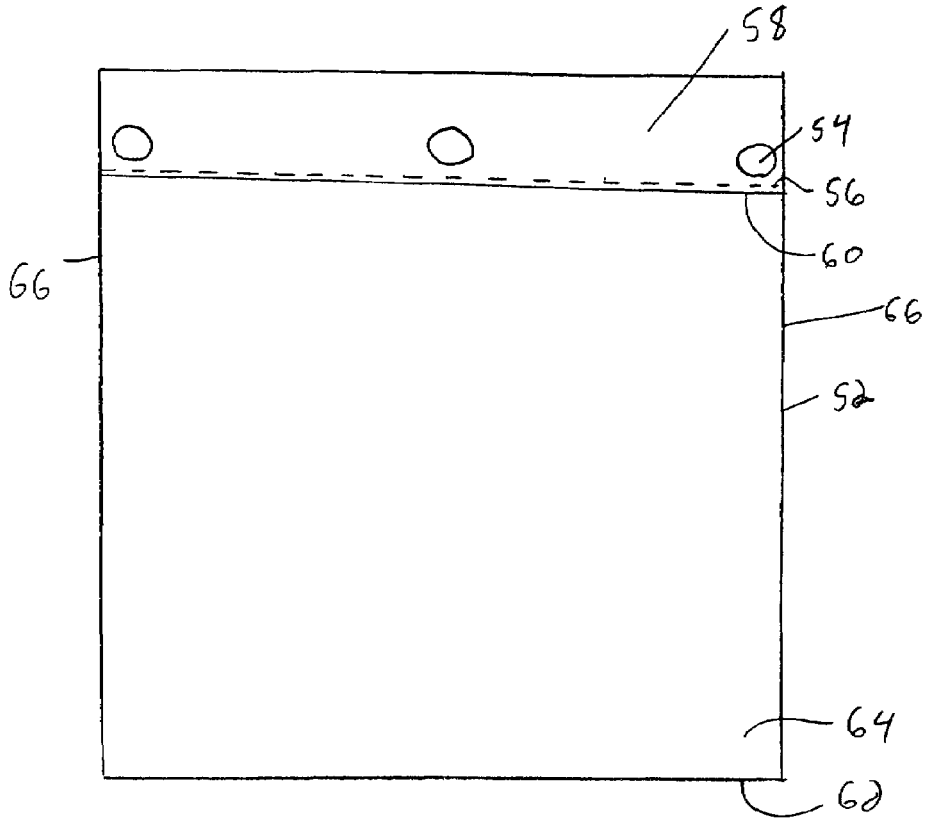
FIG. 1 is a front view of a bag according to the present disclosure.

Embodiments of the presently disclosed bag dispensing assembly will be described herein below with reference to the accompanying drawing figures wherein like reference numerals identify similar or identical elements. In the following description, well-known functions or constructions are not described in detail to avoid obscuring the disclosure in unnecessary detail. The term "proximal," as is traditional, will refer to the end that is closer to the user, while the term "distal" will refer to the end that is farther from the user.

Figure 10:
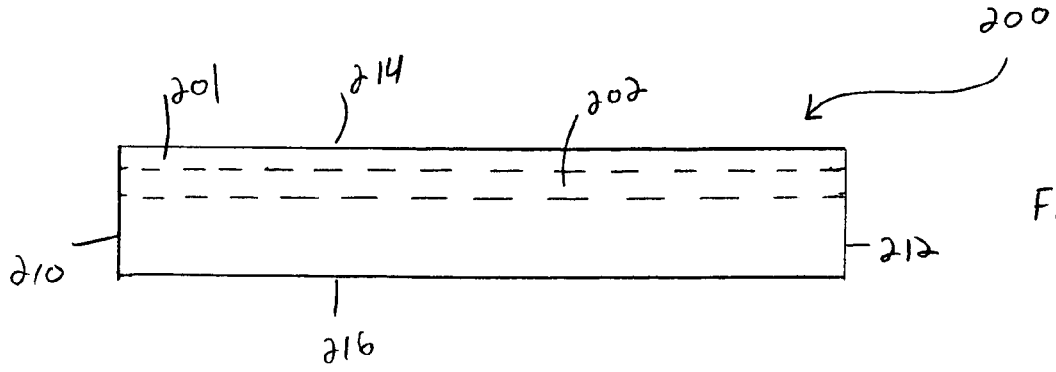
FIG. 10 is a front view of a bag dispenser according to the present disclosure.
Figure 11:
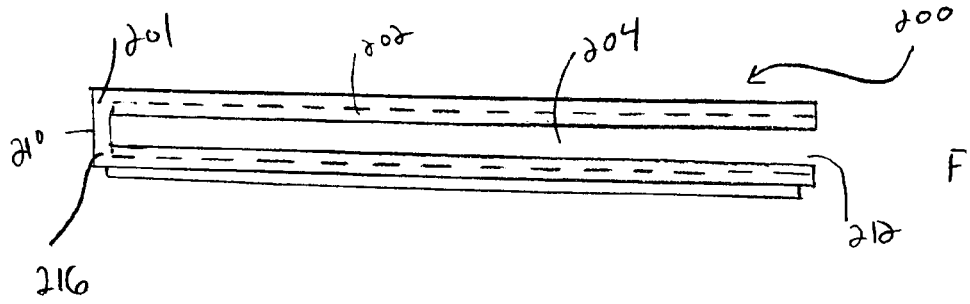
FIG. 11 is a bottom view of the bag dispenser of FIG. 10.
Figure 12:
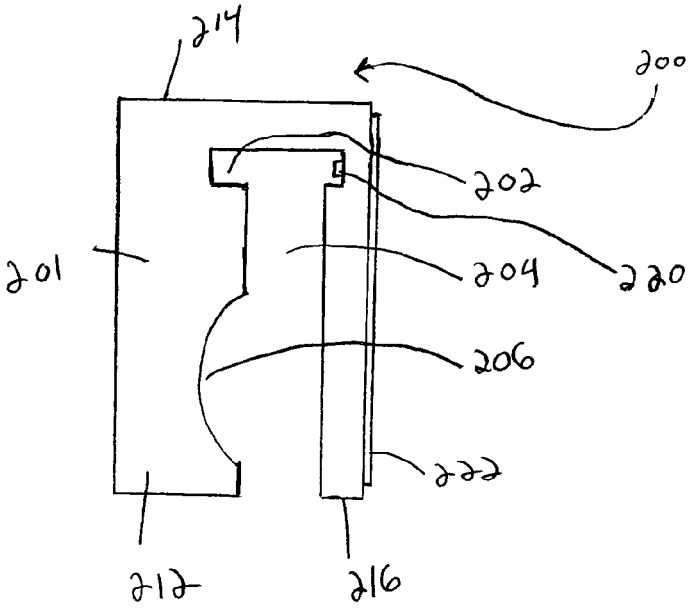
FIG. 12 is a slightly enlarged, right-side view of the bag dispenser of FIGS. 10 and 11.
Figure 13:
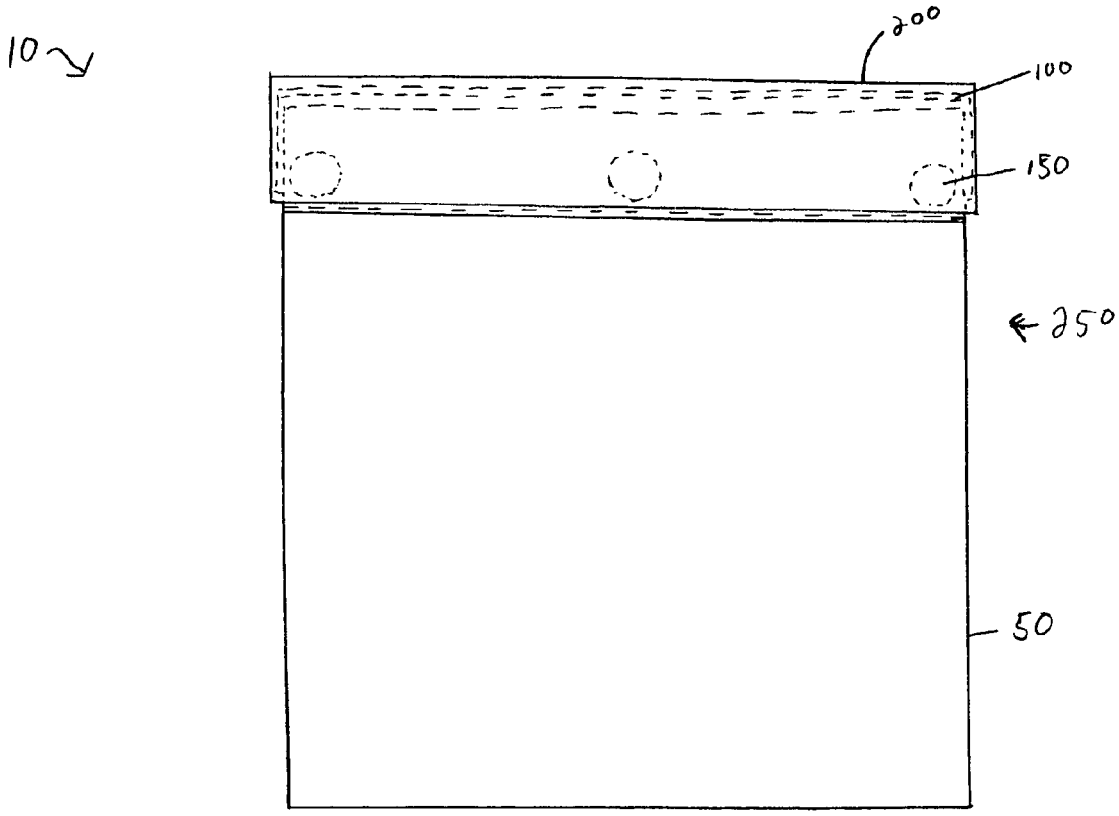
FIG. 13 is a front view of the bag dispensing assembly according to the present disclosure.
Figure 14:
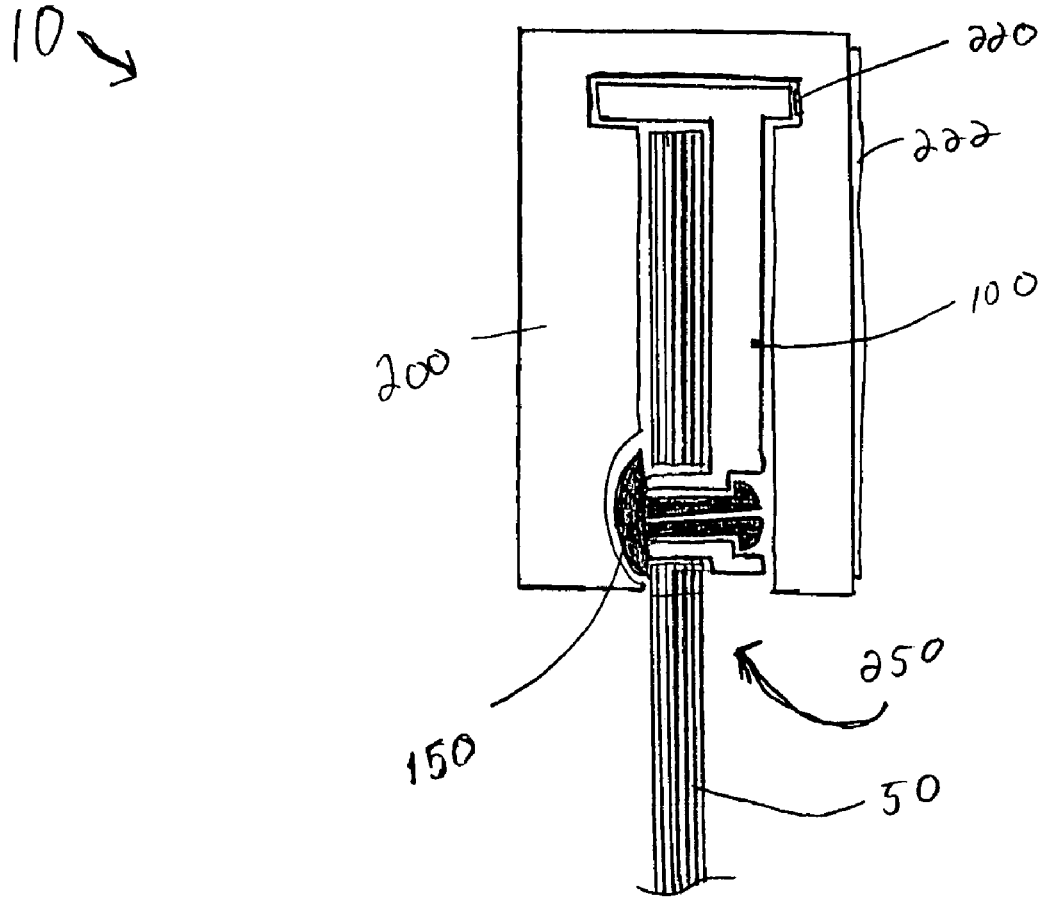
FIG. 14 is a slightly enlarged, cross-section of the bag dispensing assembly of FIG. 13.

The bag dispensing assembly is referred to generally as reference numeral 10 and is shown in FIGS. 13 and 14. The bag dispensing assembly 10 includes a plurality of bags 50 (illustrated as a single bag 52 in FIGS. 1 and 2), a bag holding cartridge 100 (FIGS. 3–5), a plurality of buttons 150 (illustrated as a single button in FIGS. 6 and 7), and a bag dispenser 200 (FIGS. 10–12).

Figure 2:
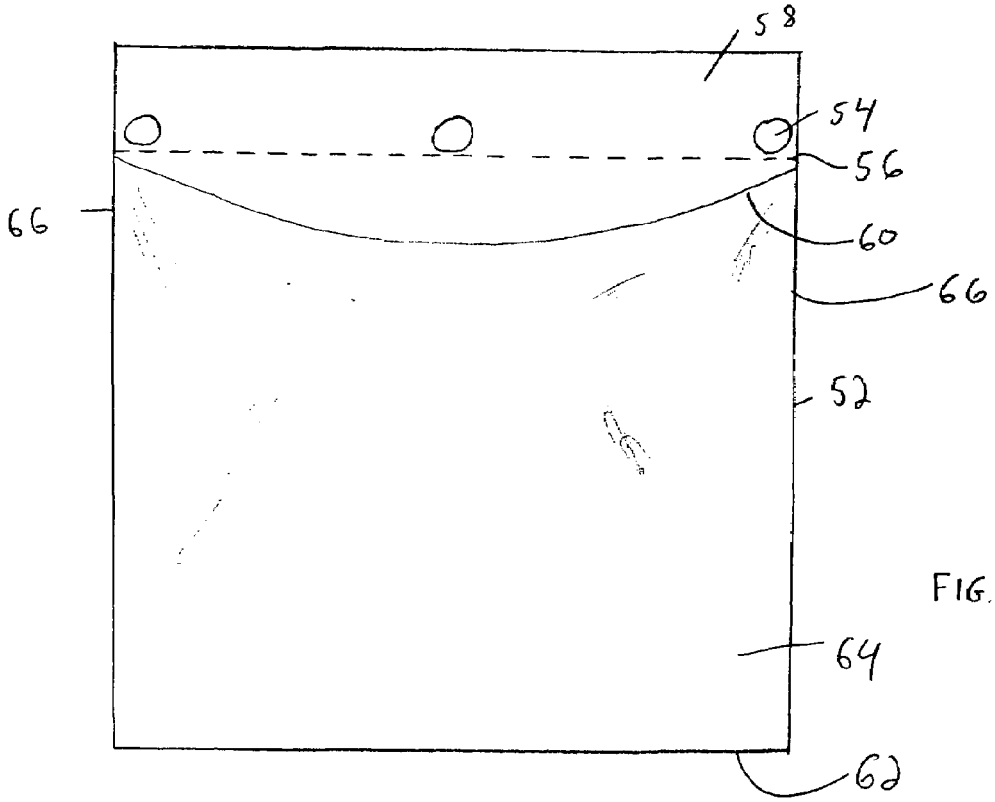
FIG. 2 is a front view of the bag of FIG. 1, showing the bag in an open position.

A single bag 52 of a plurality of bags 50 is shown in FIGS. 1 and 2. Bag 52 has a plurality of holes 54 and a perforation line 56 disposed on a proximal end 58 thereof. An open end of the bag 52 is depicted by line 60, as best seen in FIG. 2. A closed end 62 of the bag 52 is at distal end 64. Two of the plurality of holes 54 are preferably located close to perforation line 56 and close to each edge 66 (i.e., one hole 54 at each edge 66) of each bag 52.

Figure 3:
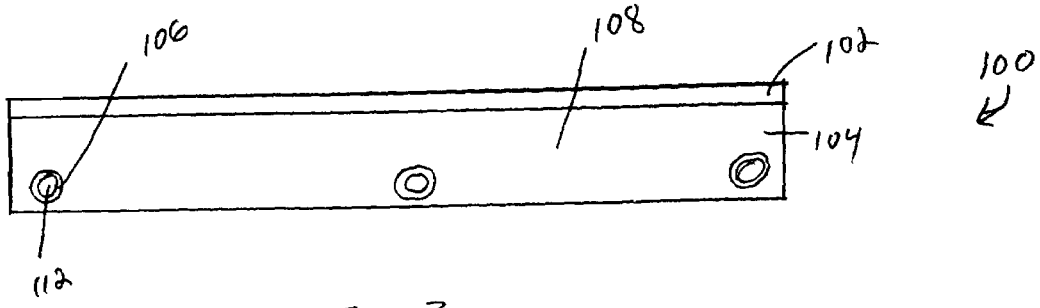
FIG. 3 is a front view of a bag holding cartridge according to the present disclosure.
Figure 4:
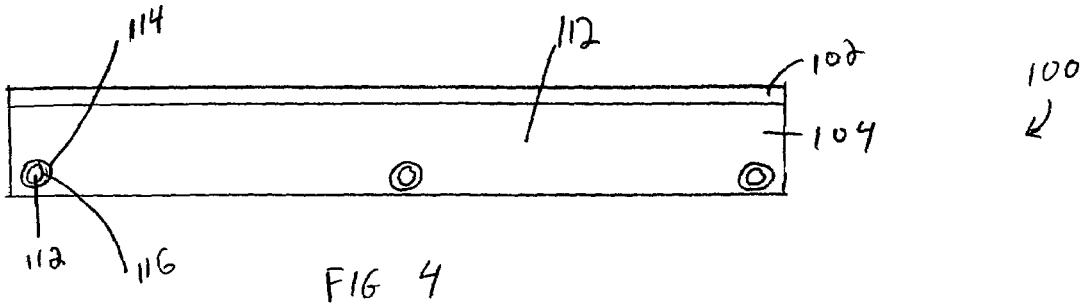
FIG. 4 is a rear view of the bag holding cartridge of FIG. 3.
Figure 5:
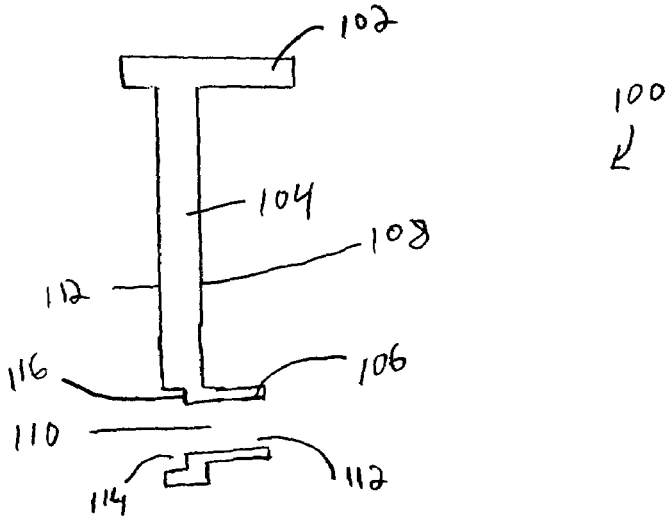
FIG. 5 is a slightly enlarged, cross-section of the bag holding cartridge of FIGS. 3 and 4.

The bag holding cartridge 100 is illustrated in FIGS. 3–5. The bag holding cartridge 100 includes a horizontal support member 102 which is rigidly affixed to vertical support member 104. A plurality of raised portions 106 extends from the front 108 of vertical support member 102. A plurality of openings 110, corresponding to the plurality of raised portions 106, extends through the thickness of the vertical support member 102 to the back 112 of vertical support member 102. The proximal opening 112 has a smaller circumference than the distal opening 114. There is a lip 116 disposed in each opening 110, separating the proximal opening 112 and the distal opening 114, to secure a button, as described in more detail below.

Figure 6:
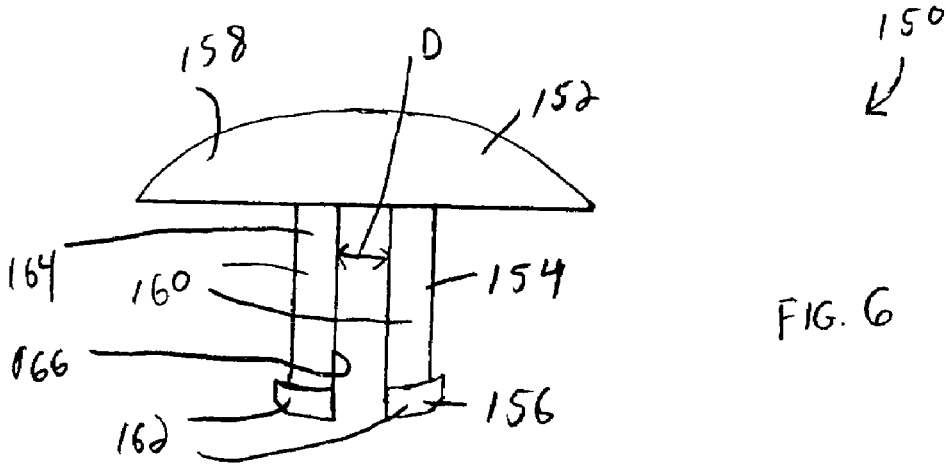
FIG. 6 is a front view of a button according to the present disclosure.
Figure 7:
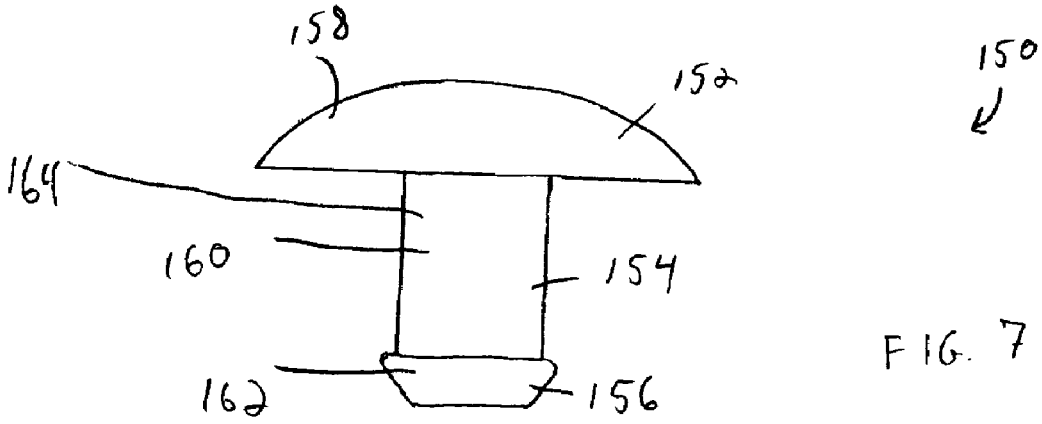
FIG. 7 is a side view of the button of FIG. 6.

A button 150 is illustrated in FIGS. 6 and 7. The button 150 includes a proximal portion 152, an intermediate portion 154 and a distal portion 156. The proximal portion includes a cap 158. The intermediate portion includes a pair of legs 160. The distal portion 156 includes a detent 162 disposed on the distal end of each leg 160. The outside 164 of each leg 160 is preferably semi-circular, while the inside 166 of each leg 160 is preferably flat. Each leg 160 is preferably separated by a distance D.

Each button 150 is dimensioned and configured to fit into each opening 110 of bag holding cartridge 100. The circumferences of the intermediate portion 154 and the distal portion 156 are calculated as the circumference of each semi-circular outside 164 of each leg 160 or detent 162, respectively, plus twice the distance D between each leg 160 or detent 162. The proximal portion 152 has a larger circumference than the circumference of the intermediate portion 154. The distal portion 156 has a larger circumference than the circumference of the intermediate portion 154. Preferably, the proximal portion 152 has a larger circumference than the circumference of the distal portion 156. Although the term circumference is used to describe the relative dimensions of each portion of button 150, it is within the scope of this disclosure for each portion of each button 150 to have any regular or irregular shape.

Figure 8:
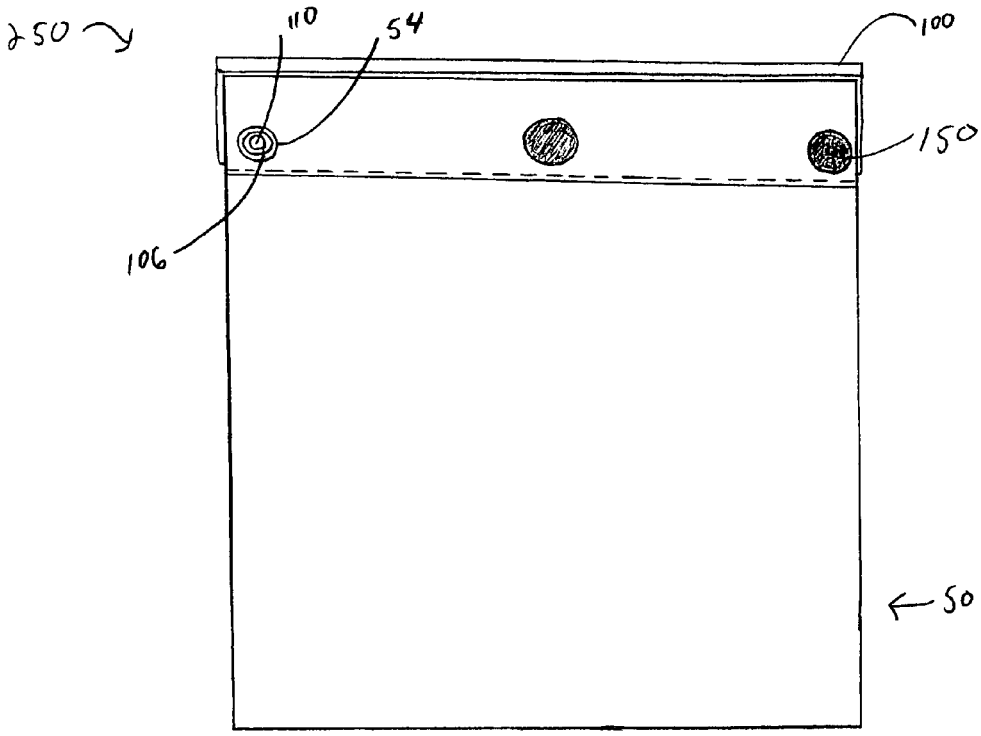
FIG. 8 is a front view of the bag of FIG. 1 placed on the bag holding cartridge of FIGS. 3–5 secured by two buttons of FIGS. 6 and 7.
Figure 9:
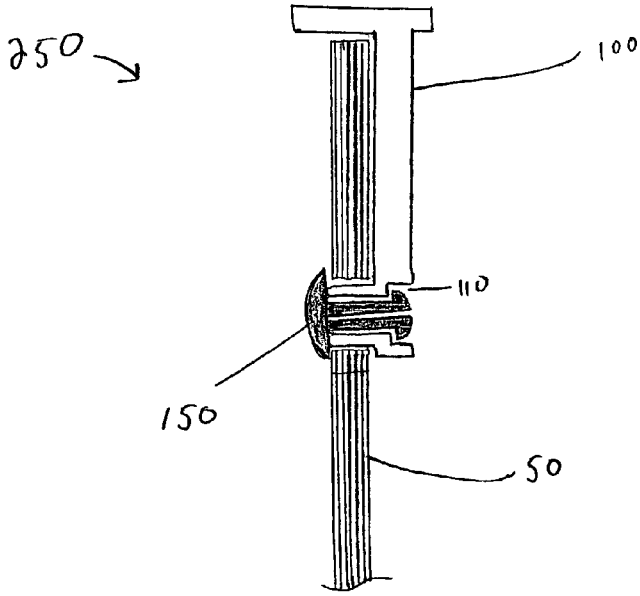
FIG. 9 is a slightly enlarged, cross-section of a plurality of the bags of FIG. 1 placed on the bag holding cartridge of FIGS. 3–5 secured by the button of FIGS. 6 and 7.

FIGS. 8 and 9 illustrate the plurality of bags 50 inserted on the bag holding cartridge 100 and secured into place with buttons 150. This embodiment is herein referred to as bag carrying assembly and is referenced by numeral 250. In FIG. 8, one raised portion 106 is depicted without a button 150, for illustrative purposes only. The plurality of bags 50 is placed on the bag holding cartridge 100, with the holes 54 of bags 50 lining up with the raised portions 106 of bag holding cartridge 100. One button 150 is then inserted into each raised portion 106 to securely hold the bags 50 in the bag holding cartridge 100. The distal portion 156 of button 150 has a larger circumference than the circumference of the proximal opening 112. The intermediate portion 154 of button 150 has a smaller circumference than the circumference of proximal opening 112. The proximal portion 152 of button 150 has a larger circumference than the circumference of raised portion 106. Additionally, the circumference of the proximal portion 152 of button 150 is larger than the circumference of each hole 54 of bag 52, prohibiting a bag 52 from becoming dislodged from under button 150.

When applying a force to proximal portion 152 of button 150 to insert button 150 into opening 110 of bag holding cartridge 100, the legs 160 of button 150 are deflected toward each other, decreasing the distance D, and thus decreasing the circumference of the intermediate portion 154 and the distal portion 156. The legs 160 are able to be deflected because they are cantileveredly attached to proximal portion 152. The legs 160 are further deflected until the circumference of distal portion 156 is smaller than the circumference of proximal opening 112. The continued application of force then pushes the distal portion 156 of button 150 through proximal opening 112, over lip 116, and eventually into distal opening 114 where the legs 160 are then able to return to their original position with respect to one another. The button 150 is now secured in place, thus securing the plurality of bags 50 between the proximal portion 152 of button 150 and vertical support member 104.

The bag dispenser 200 is illustrated in FIGS. 10–12. The bag dispenser 200 includes a housing 201, a horizontal slot 202, a vertical slot 204 and an arcuate indentation 206. The horizontal slot 202 is dimensioned and configured to accept the horizontal support member 102 of bag holding cartridge 100. The vertical slot 204 is dimensioned and configured to accept the vertical support member 104 of bag holding cartridge 100 along with plurality of bags 50. The arcuate indentation 206 is shaped to allow the cap 158 of button 150 to pass through. It is also envisioned that the cap 158 does not have an arcuate profile. In such an embodiment, the indentation 206 on the vertical slot 204 would substantially match the profile of the proximal portion 152 of button 150. The bag dispenser 200 is closed on its distal end 210, while the slots 202 and 204 form an opening on the proximal end 212 thereof. Top 214 of bag dispenser 200 is closed, while the vertical slot 204 extends through bottom 216 of bag dispenser 200, thus creating a partially open bottom 216.

In a preferred embodiment, a catch 220 is disposed towards the open, proximal end 212 of bag dispenser 200 for further securing the bag carrying assembly 250 therein, such that the catch 220 will prevent the bag carrying cartridge 250 from falling out of the bag dispenser 200 unintentionally.

FIGS. 13 and 14 illustrate the bag carrying assembly 250 inserted into bag dispenser 200. The plurality of bags 50 is shown inserted into bag holding cartridge 100 and affixed thereto with button 150. Bag carrying assembly 250 is shown inserted into bag dispenser 200 to form bag dispensing assembly 10.

In a preferred embodiment, a magnet 222 is disposed on a part of the housing 201 that is parallel to vertical slot 204. The magnet 222 allows the bag dispensing assembly 10 to be releasably affixed to a magnetic surface. It is also within the scope of this disclosure to utilize other affixing means to secure bag dispensing assembly 10 to a surface.

In use, a user who desires to obtain a bag 52 from bag dispensing assembly 10 grabs bag 52 and pulls it away from bag dispensing assembly 10. In a preferred embodiment, the bag 52 will tear along its perforation line 56, creating a clean tear. Such a clean tear is facilitated by the location of holes 54 being close to the perforation line 56 and near the edges 66 of bag 52. It is also envisioned for a user to be able to tear multiple bags 52 at one time.

Additionally, when no bags 52 remain on bag holding cartridge 100, the bag holding cartridge 100 can be removed from bag dispensing assembly 10, and replaced with another bag carrying cartridge 250, including a plurality of bags 50. It is also envisioned that instead of replacing the bag carrying cartridge 250, a plurality of bags 50 can be inserted onto the same bag holding cartridge 100 and secured with the same buttons 150.

While the above description contains many specifics, these specifics should not be construed as limitations on the scope of the disclosure, but merely as exemplifications of preferred embodiments thereof. Those skilled in the art will envision many other possible variations that are within the scope and spirit of the disclosure as defined by the claims appended hereto.

What is claimed is:

1. A bag dispensing assembly for holding a plurality of bags and for dispensing individual bags, comprising:

a plurality of bags, each bag having a plurality of holes proximally disposed on the bag and a perforation line disposed on the distal side of the plurality of holes;

a bag holding cartridge for holding the plurality of bags, the bag holding cartridge having a horizontal support member affixed to a vertical support member, the vertical support member having a plurality of raised portions extending therefrom and having corresponding openings extending through each raised portion and through the thickness of vertical support member, and each raised portion for receiving one hole of the plurality of holes on each of the plurality of bags;

a plurality of buttons, each button for being inserted into each opening of the bag holding cartridge and for securing the plurality of bags to the bag holding cartridge; and a bag dispenser for receiving and maintaining the bag holding cartridge, the bag dispenser having a housing with a top, a bottom, a proximal portion and a distal portion, the bag dispenser having a horizontal slot and a vertical slot disposed in the housing for accepting the horizontal and vertical support members of the bag holding cartridge, the vertical slot extending through the bottom of the bag dispenser and further including an indentation for accepting the plurality of buttons, and the horizontal slot, the vertical slot and the indentation extending from the proximal portion substantially through a length of the bag dispenser.

2. The bag dispensing assembly of claim 1 wherein the bag having two edges and one hole of the plurality of holes being disposed near each edge of the bag and near the perforation line for allowing the bag the be easily removed from the bag dispenser at the perforation line.

3. The bag dispensing assembly of claim 1 wherein each of the plurality of buttons having a proximal portion with a circumference, an intermediate portion with a circumference and a distal portion with a circumference.

4. The bag dispensing assembly of claim 3 wherein the proximal portion of each of the plurality of buttons having a semi-circular, arcuate shape.

5. The bag dispensing assembly of claim 3 wherein the proximal circumference being the largest and the intermediate circumference being the smallest.

6. The bag dispensing assembly of claim 3 wherein the intermediate portion of each of the plurality of buttons comprises two legs.

7. The bag dispensing assembly of claim 6 wherein each of the two legs of each of the plurality of buttons extending cantileveredly from the proximal portion, each leg being capable of deflecting in response to an external force.

8. The bag dispensing assembly of claim 7 wherein the distal portion of each of the plurality of buttons comprises a detent disposed on the distal portion of the two legs, the detent having a circumference that is greater than the intermediate circumference and is smaller than the proximal circumference.

9. The bag dispensing assembly of claim 8 wherein each raised portion of the plurality of raised portions having a circumference that is smaller than a circumference of a corresponding hole of the plurality of holes on the bag.

10. The bag dispensing assembly of claim 9 wherein each opening of the bag holding cartridge having a proximal circumference and a distal circumference, the proximal circumference being smaller than the distal circumference, the proximal circumference being smaller than the circumference of the distal portion of the button, the proximal circumference being larger than the intermediate portion of the button, the distal circumference being larger than the circumference of the distal portion of the button, for allowing the distal portion of the button to engage the opening in a snap-fit relationship.

11. The bag dispensing assembly of claim 1 wherein the vertical slot of the bag dispenser having a width appropriately sized for accepting the vertical support member of the bag holding cartridge and the plurality of bags secured thereon.

12. The bag dispensing assembly of claim 4 wherein the indentation on the vertical slot of the bag dispenser having an arcuate shape for accepting the proximal portion of the button.

13. The bag dispensing assembly of claim 1 wherein the horizontal slot of the bag dispenser having an appropriate thickness for accepting the horizontal support member of the bag holding cartridge.

14. The bag dispensing assembly of claim 1 further including a catch disposed on the proximal portion of the horizontal slot of the bag dispenser for releasably securing the bag holding cartridge within the bag dispenser.

15. The bag dispensing assembly of claim 1 further including a catch disposed on the proximal portion of the vertical slot of the bag dispenser for releasably securing the bag holding cartridge within the bag dispenser.

16. The bag dispensing assembly of claim 1 further including a magnet disposed on the bag dispenser for releasably attaching to a magnetic surface.

17. The bag dispensing assembly of claim 1 further including indicia disposed on each bag of the plurality of bags.

18. The bag dispensing assembly of claim 1 further including indicia disposed on the bag dispenser.

* * * * *